US009229346B2

(12) United States Patent
Yotsutsuji et al.

(10) Patent No.: US 9,229,346 B2
(45) Date of Patent: Jan. 5, 2016

(54) IMAGE FORMING APPARATUS THAT CONTROLS DISCHARGE AND REPLENISHMENT OF DEVELOPER BASED ON THE ELECTRIC CHARGE AMOUNT OF THE DEVELOPER CONTAINED IN DEVELOPING PART AND COMPOSITIONS OF EXISTING DEVELOPER AND NEW DEVELOPER

(71) Applicant: KYOCERA DOCUMENT SOLUTIONS INC., Osaka (JP)

(72) Inventors: Takefumi Yotsutsuji, Osaka (JP); Yukihiro Mori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/957,235

(22) Filed: Aug. 1, 2013

(65) Prior Publication Data

US 2014/0056600 A1 Feb. 27, 2014

(30) Foreign Application Priority Data

Aug. 21, 2012 (JP) ..... 2012-182691

(51) Int. Cl.
*G03G 15/08* (2006.01)
*G03G 13/08* (2006.01)

(52) U.S. Cl.
CPC ..... *G03G 13/08* (2013.01); *G03G 15/0851* (2013.01); *G03G 15/0877* (2013.01)

(58) Field of Classification Search
CPC ..... G03G 15/0844; G03G 15/0851; G03G 15/0863; G03G 15/0865; G03G 15/0877
See application file for complete search history.

(56) References Cited

U.S. PATENT DOCUMENTS 4,912,512 A 3/1990 Midorikawa et al.
5,486,900 A * 1/1996 Wada et al. ..... 399/27

(Continued)

FOREIGN PATENT DOCUMENTS

JP 01-232360 A 9/1989
JP 2003-186354 * 7/2003 ..... G03G 21/00

(Continued)

OTHER PUBLICATIONS

USPTO English translation of JP2003-186354, provided by Schreiber Translations, Inc.*

(Continued)

*Primary Examiner* — David Gray
*Assistant Examiner* — Thomas Giampaolo, II
(74) *Attorney, Agent, or Firm* — Studebaker & Brackett PC

(57) ABSTRACT

In an image forming apparatus, a case containing a developer includes a first storage storing developer information indicating a composition of the developer. A developing part receives the developer from the developer-containing case. An acquiring part acquires the developer information in the first storage, when the developer-containing case is installed to an installed part. A decision part decides whether or not a composition of the developer in existing developer information in a second storage is different from another composition of the developer in newly acquired developer information. An electric charge amount measuring part measures an electric charge amount of the developer in the developing part. A developer replacement controlling part controls discharge and replenishment of the developer in the developing part on the basis of the measured electric charge amount, when the decision part decides that both compositions are different.

3 Claims, 7 Drawing Sheets

(56) References Cited

U.S. PATENT DOCUMENTS

| | | | | |
|---|---|---|---|---|
| 6,301,449 | B1 * | 10/2001 | Miura | 399/12 |
| 2004/0170441 | A1 * | 9/2004 | Forbes et al. | 399/27 |
| 2010/0080576 | A1 * | 4/2010 | Nakayama et al. | 399/30 |
| 2010/0104323 | A1 * | 4/2010 | Toizumi et al. | 399/252 |
| 2011/0318024 | A1 * | 12/2011 | Kawaguchi | 399/27 |
| 2012/0082927 | A1 * | 4/2012 | Kamoto et al. | 430/105 |

FOREIGN PATENT DOCUMENTS

| | | | | | |
|---|---|---|---|---|---|
| JP | 2003-186354 | A | | 7/2003 | |
| JP | 2006-214975 | | * | 8/2006 | G01R 29/24 |
| JP | 2006-243114 | | * | 9/2006 | G03G 21/00 |
| JP | 2006-243114 | A | | 9/2006 | |
| JP | 2007-322936 | | * | 12/2007 | G03G 15/08 |
| JP | 2007-322936 | A | | 12/2007 | |
| JP | 2009-104018 | | * | 5/2009 | G03G 15/08 |
| JP | 2010-032947 | | * | 2/2010 | G03G 15/08 |

OTHER PUBLICATIONS

USPTO English translation of JP2006-243114, provided by the McElroy Translation Company.*

TREK Application Note No. 1001, "Compact Toner Draw-off Charge Measurement System: Model 210HS-2B", dated Jan. 8, 2007, obtained from: https://web.archive.org/web/20070108050157/http://trekinc.com/PDF/1001_Toner_Draw-off.PDF.*

An Office Action; "Notice of Reasons for Rejection," issued by the Japanese Patent Office on Jul. 15, 2014, which corresponds to Japanese Patent Application No. 2012-182691 and is related to U.S. Appl. No. 13/957,235.

* cited by examiner 13-01965

IMAGE FORMING APPARATUS THAT CONTROLS DISCHARGE AND REPLENISHMENT OF DEVELOPER BASED ON THE ELECTRIC CHARGE AMOUNT OF THE DEVELOPER CONTAINED IN DEVELOPING PART AND COMPOSITIONS OF EXISTING DEVELOPER AND NEW DEVELOPER

INCORPORATION BY REFERENCE

This application is based on and claims the benefit of priority from Japanese Patent application No. 2012-182691 filed on Aug. 21, 2012, the entire contents of which are incorporated herein by reference.

BACKGROUND

The present disclosure relates to an image forming apparatus developing an electrostatic latent image.

An electrographic image forming apparatus, such a copying machine, a printer or a facsimile, uses processes of supplying a toner (a developer) to an electrostatic latent image formed on a surface of an image carrier, such as a photosensitive drum, developing the electrostatic latent image as a toner image and transferring and fixing the toner image to a recording medium.

In such an image forming apparatus, as the toner image is formed on the surface of the photosensitive drum, the toner is consumed. Therefore, in order to maintain a fixed quantity of toner density (a rate of the toner to a carrier) of the developer contained in a development device, the toner is supplied to the development device from a toner cartridge.

Generally, a composition of the toner in the toner cartridge is same as the toner existing in the development device in advance. Thereby, a change in hue and a change of an electric charge amount when the toner cartridge is replaced are restrained as possible.

However, the composition of the toner in the toner cartridge may be changed according to running change, compatibility or the like. Then, when the electric charge amount of the toner in the toner cartridge is different from the electric charge amount of the toner existing in the development device, it is feared that developability is varied according to a mixture quantity and an image quality of a printed matter is degraded.

To such problems, for example, a method of detecting identification information from a toner cartridge having the identification information for identify characteristics of the inner toner and controlling copying process condition on the basis of the identification information is proposed. In this method, when a replacement rate of the toner reaches fifty percent, the control of the copying process condition is started.

Moreover, in another proposed method, when another toner cartridge for another toner having different composition from a toner existing in a development device in advance is installed, a consumption of the toner is added up until the toner existing in the development device in advance is replaced to the new toner. On the basis of the addition of the toner consumption, a form factor and particle diameter of the toner and other factors, parameters in relation to a development bias are changed.

However, a mixing rate of new replenishment toner and toner existing in the development device in advance continues varying all until the toner is completely replaced. By contrast, in the above-mentioned former method, because the control of the copying process condition is started when the toner replacement rate is reached to fifty percent, the image quality of the printed matter often becomes unstable.

In addition, the mixing rate of the new replenishment toner and the toner existing in the development device in advance is varied according to temperature, humidity and toner density. By contrast, in the above-mentioned latter method, because the temperature, humidity and toner density are not taken into account, the image quality of the printed matter is not sufficiently stabilized.

Thus, in the above-mentioned methods, the image quality of the printed matter is not stabilized until the toner existing in the development device in advance is completely replaced by the new replenishment toner. Therefore, an image forming apparatus capable to early stabilize the image quality is required.

SUMMARY

In accordance with an embodiment of the present disclosure, an image forming apparatus includes an installed part, a developing part, an acquiring part, a second storage, a decision part, an electric charge amount measuring part and a developer replacement controlling part. To the installed part, a developer containing case is installed. The developer containing case contains a developer and includes a first storage storing developer information indicating a composition of the contained developer. The developing part receives the developer supplied from the developer containing case installed to the installed part and supplies the received developer to a surface of an image carrier. The acquiring part acquires the developer information stored in the first storage of the developer containing case, when the developer containing case is installed to the installed part. The second storage stores the developer information acquired by the acquiring part. The decision part decides whether or not a composition of the developer included in the existing developer information is different from another composition of the developer included in new developer information newly acquired by the acquiring part, when existing developer information is stored in the second storage. The electric charge amount measuring part measures an electric charge amount of the developer contained in the developing part. The developer replacement controlling part controls discharge of the developer contained in the developing part and replenishment of the developer contained in the developer containing case installed in the installed part to the developing part on the basis of the electric charge amount measured by the electric charge amount measuring part, when the decision part decides that both the compositions of the developers are different from each other.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
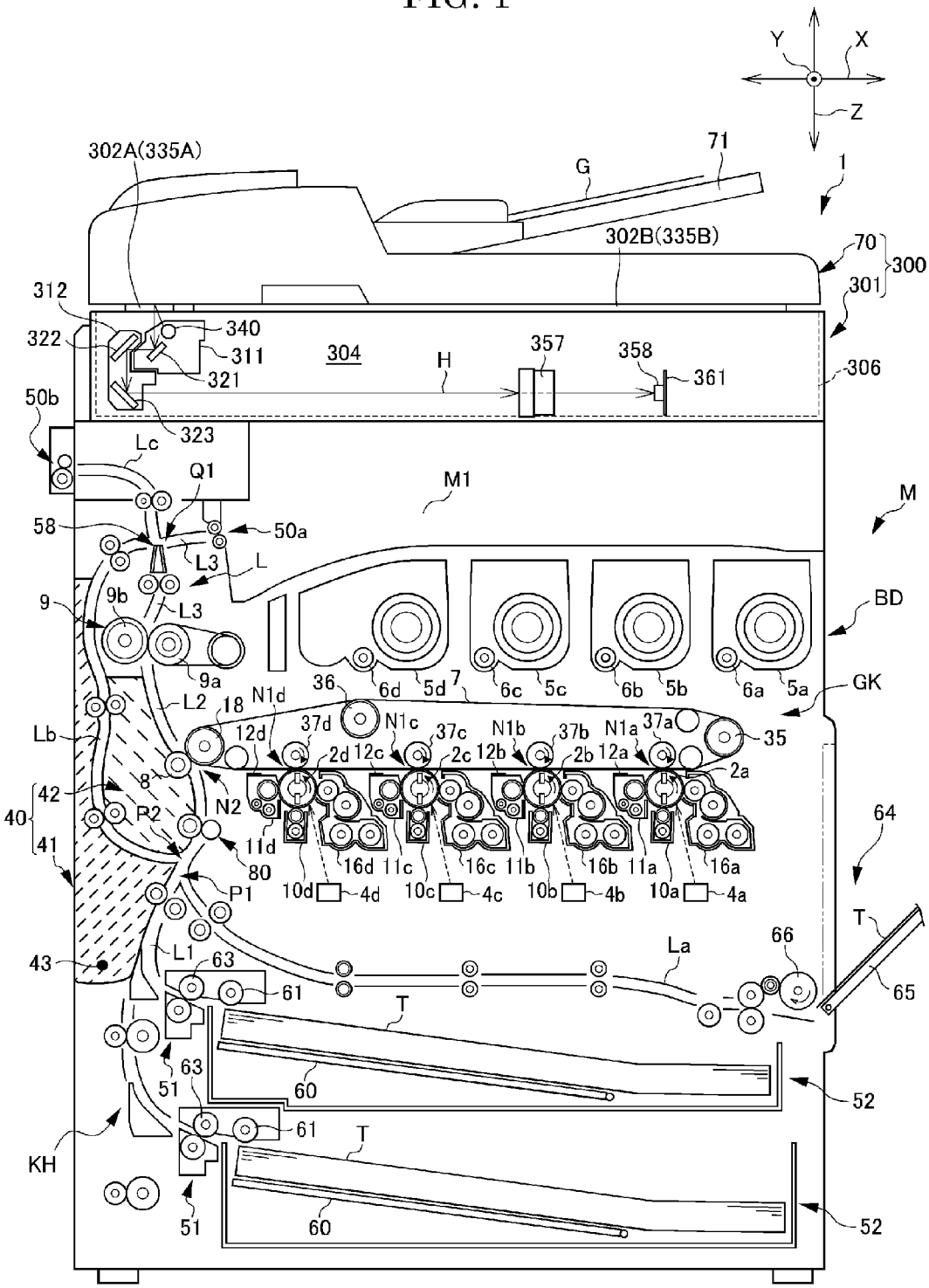
FIG. 1 is a schematic diagram schematically showing arrangement of components in a copying machine according to an embodiment of the present disclosure.

In the following, an embodiment of an image forming apparatus of the present disclosure will be described with reference to the drawings. With reference to FIG. 1, an entire configuration of a copying machine 1 as the image forming apparatus of the embodiment will be described. FIG. 1 is a diagram used for explaining arrangement of components in the copying machine 1.

As shown in FIG. 1, the copying machine 1 as the image forming apparatus includes an image reading device 300 and an apparatus main body M. The image reading device 300 is located at an upper side in upper and lower direction Z in the copying machine 1. The apparatus main body M is located at a lower side in the upper and lower direction Z in the copying machine 1 and forms a toner image to a sheet T as a sheet-liked substance to be transferred on the basis of image information read by the image reading device 300. In the description about the copying machine 1, a sub scanning direction X is often called as a "left and right directions" of the copying machine 1 and a main scanning direction Y (a direction perpendicular to a paper surface of FIG. 1) is often called as a "forward and backward directions" of the copying machine 1. The upward and downward directions of the copying machine 1 cross the sub scanning direction X and main scanning direction Y at right angles.

First, the image reading device 300 will be described. As shown in FIG. 1, the image reading device 300 includes a reading part 301 and a document conveying part 70. The reading part 301 reads an image of a document G. The document conveying part 70 is located at an upper side of the reading part 301 and conveys the document G to the reading part 301.

The reading part 301 includes a housing 306, and a first reading face 302A and a second reading face 302B located at an upper side of the housing 306. The reading part 301 also includes, in an internal space 304 of the housing 306, a lighting part 340 having a light source, a plurality of mirrors 321, 322 and 323, and a first frame body 311 and a second frame body 312 moving in the sub scanning direction X. The lighting part 340 and first mirror 321 are installed in the first frame body 311. The second mirror 322 and third mirror 323 are installed in the second frame body 312. Moreover, in the internal space 304 of the housing 306, an imaging lens 357, a CCD (Charge Coupled Device) 358 as a reader and a CCD circuit board 361 are provided. The CCD circuit board 361 carries out a predetermined process to image information read by the CCD 358 and outputs the image information to a side of the apparatus main body M.

The document conveying part 70 is openably/closably connected to the reading part 301 by a connect part (not shown). The document conveying part 70 includes a document placement part 71 at an upper side and a feed roller (not shown) inside. The document conveying part 70 also has a function of protecting the first reading face 302A and second reading face 302B of the reading part 301.

The first reading face 302A is a reading face used in a case of reading the document G conveyed by the document conveying part 70. The first reading face 302A is formed along an upper face of a first contact glass 335A on which the document G is conveyed. The first reading face 302A is positioned near a left side face of the housing 306. This position shown in FIG. 1 is often called as a "first reading position".

The second reading face 302B is another reading face used in another case of reading the document G without using the document conveying part 70. The second reading face 302B is formed along an upper face of a second contact glass 335B on which the document G is placed. The second reading face 302B is located at the right side of the first reading face 302A over the great part in the sub scanning direction X of the reading part 301. The first reading face 302A and second reading face 302B are extended in a direction crossing the sub scanning direction X and main scanning direction Y at right angles.

When the document G conveyed by the document conveying part 70 is read, the document G is placed on the document placement part 71. The document G placed on the document placement part 71 is conveyed on the first reading face 302A of the reading part 301 by the feed roller provided inside the document conveying part 70. In this case, the first frame body 311 and second frame body 312 are positioned at the first reading position, but not moved. As the document G is conveyed so as to slide on the first reading face 302A by the document conveying part 70, an image formed on a surface of the document G is read by the CCD 358.

On the other hand, when the document conveying part 70 is in an opening state, the document G is placed on the second reading face 302B. In this case, the first frame body 311 and second frame body 312 are moved in the sub scanning direction X with keeping a length (an optical path length) of an optical path H mentioned below constant. Thereby, the image of the document G placed on the second reading face 302B is read.

In the internal space 304 of the housing 306, the plurality of the mirrors 321, 322 and 323 make the optical path H bringing an incident light from the document G to the imaging lens 357. Because the first frame body 311 is moved in the sub scanning direction X at a predetermined speed A and the second frame body 312 is moved in the sub scanning direction X at a predetermined speed A/2, the length of the optical path His kept constant in an image reading operation. The reading part 301 will be described in detail as follows.

Next, the apparatus main body M will be described. The apparatus main body M includes an image forming part GK and a sheet feeding/ejecting part KH. The image forming part GK forms a given toner image on the sheet T on the basis of given image information. The sheet feeding/ejecting part KH feeds the sheet T to the image forming part GK and ejects the sheet T on which the toner image is formed. An outer shape of the apparatus main body M is formed by a case body BD as a housing.

As shown in FIG. 1, the image forming part GK includes photosensitive drums 2*a*, 2*b*, 2*c* and 2*d* as image carriers (photosensitive members), chargers 10*a*, 10*b*, 10*c* and 10*d*, laser scanning units 4*a*, 4*b*, 4*c* and 4*d* as exposure units, development devices (developing parts) 16*a*, 16*b*, 16*c* and 16*d*, toner cartridges (developer containing cases) 5*a*, 5*b*, 5*c* and 5*d*, toner supply parts 6*a*, 6*b*, 6*c* and 6*d*, drum cleaning parts 11*a*, 11*b*, 11*c* and 11*d*, static eliminators 12*a*, 12*b*, 12*c* and 12*d*, an intermediate transferring belt 7, first transfer rollers 37*a*, 37*b*, 37*c* and 37*d*, a second transfer roller 8, a facing roller 18 and a fixing part 9.

As shown in FIG. 1, the sheet feeding/ejecting part KH includes sheet feeding cartridges 52, a manual bypass sheet feeding part 64, a conveying path L for the sheet T, a pair of registration rollers 80, a first sheet ejecting part 50*a* and a second sheet ejecting part 50*b*. The conveying path L is an aggregate of a first conveying path L1, a second conveying path L2, a third conveying path L3, a manual bypass conveying path La, a return conveying path Lb and a post-process conveying path Lc mentioned below.

In the following, the configurations of the image forming part GK and sheet feeding/ejecting part KH will be described in detail. First, the image forming part GK will be described. The image forming part GK carries out, along surfaces of the photosensitive drums 2*a*, 2*b*, 2*c* and 2*d* in order from an upper stream side to a lower stream side, electrical charges by the chargers 10*a*, 10*b*, 10*c* and 10*d*, exposures by the laser scanning units 4*a*, 4*b*, 4*c* and 4*d*, development by the development devices 16*a*, 16*b*, 16*c* and 16*d*, first transfers by the intermediate transferring belt 7 and first transfer rollers 37*a*, 37*b*, 37*c* and 37*d*, static eliminations by the static eliminators 12*a*, 12*b*, 12*c* and 12*d*, and cleaning by the drum cleaning parts 11*a*, 11*b*, 11*c* and 11*d*, respectively. The image forming part GK also carries out second transfer by the intermediate transferring belt 7, second transfer roller 8 and facing roller 18, and fixation by the fixing part 9.

The photosensitive drums 2*a*, 2*b*, 2*c* and 2*d* are formed by respective cylinder-liked members and function as photosensitive members or image carriers. The photosensitive drums 2*a*, 2*b*, 2*c* and 2*d* are located so as to rotate in a direction indicated by an arrow in the figure around respective rotation axes extending in a direction crossing a forward direction of the intermediate transferring belt 7 at right angles. On the surfaces of the photosensitive drums 2*a*, 2*b*, 2*c* and 2*d*, an electrostatic latent image can be formed.

The chargers 10*a*, 10*b*, 10*c* and 10*d* are respectively located facing to the surfaces of the photosensitive drums 2*a*, 2*b*, 2*c* and 2*d*. The chargers 10*a*, 10*b*, 10*c* and 10*d* charge the respective surfaces of the photosensitive drums 2*a*, 2*b*, 2*c* and 2*d* to uniform negative electricity (minus polarity) or positive electricity (plus polarity).

The laser scanning units 4*a*, 4*b*, 4*c* and 4*d* function as respective exposure units and are respectively located apart from the surfaces of the photosensitive drums 2*a*, 2*b*, 2*c* and 2*d*. Each of the laser scanning units 4*a*, 4*b*, 4*c* and 4*d* is configured to have a laser light source, a polygon mirror, a polygon mirror driving motor and other components (not shown).

The laser scanning units 4*a*, 4*b*, 4*c* and 4*d* respectively scan and expose the surfaces of the photosensitive drums 2*a*, 2*b*, 2*c* and 2*d* on the basis of the image information relating to the image read by the reading part 301. By the scans and exposures of the respective laser scanning units 4*a*, 4*b*, 4*c* and 4*d*, electrical charges on the exposed parts of the surfaces of the photosensitive drums 2*a*, 2*b*, 2*c* and 2*d* are respectively eliminated. Thereby, electrostatic latent images are formed on the respective surfaces of the photosensitive drums 2*a*, 2*b*, 2*c* and 2*d*.

The development devices 16*a*, 16*b*, 16*c* and 16*d* correspond to the respective photosensitive drums 2*a*, 2*b*, 2*c* and 2*d* and are located facing to the surfaces of the respective photosensitive drums 2*a*, 2*b*, 2*c* and 2*d*. The development devices 16*a*, 16*b*, 16*c* and 16*d* respectively apply respective color toners (developers) to the electrostatic latent images formed on the surfaces of the photosensitive drums 2*a*, 2*b*, 2*c* and 2*d* to form color toner images on the surfaces of the respective photosensitive drums 2*a*, 2*b*, 2*c* and 2*d*. The development devices 16*a*, 16*b*, 16*c* and 16*d* also respectively correspond to four colors of yellow, cyan, magenta and black. Each of the development devices 16*a*, 16*b*, 16*c* and 16*d* is configured to have a developing roller located facing to the surface of the photosensitive drum 2*a*, 2*b*, 2*c* or 2*d*, a stirring roller stirring the toner and other components.

The toner cartridges 5*a*, 5*b*, 5*c* and 5*d* respectively correspond to the development devices 16*a*, 16*b*, 16*c* and 16*d* and contain the respective color toners supplied to the development devices 16*a*, 16*b*, 16*c* and 16*d*. The toner cartridges 5*a*, 5*b*, 5*c* and 5*d* respectively contain yellow toner, cyan toner, magenta toner and black toner. To the toner cartridges 5*a*, 5*b*, 5*c* and 5*d*, RFID (Radio Frequency Identification) tags TG as first storages are fixed. The RFID tags TG of the toner cartridges 5*a*, 5*b*, 5*c* and 5*d* previously store toner information (developer information) indicating compositions of the toners contained in the toner cartridges 5*a*, 5*b*, 5*c* and 5*d*, respectively. The toner cartridges 5*a*, 5*b*, 5*c* and 5*d* are installed to respective housings (not shown) as installed parts.

The toner supply parts 6*a*, 6*b*, 6*c* and 6*d* respectively correspond to the toner cartridges 5*a*, 5*b*, 5*c* and 5*d* and development devices 16*a*, 16*b*, 16*c* and 16*d*, and supply the respective color toners contained in the toner cartridges 5*a*, 5*b*, 5*c* and 5*d* to the development devices 16*a*, 16*b*, 16*c* and 16*d*. The toner supply parts 6*a*, 6*b*, 6*c* and 6*d* are respectively connected to the development devices 16*a*, 16*b*, 16*c* and 16*d* by toner supply paths (not shown).

To the intermediate transferring belt 7, the respective color toner images formed on the photosensitive drums 2*a*, 2*b*, 2*c* and 2*d* are first-transferred in sequence. The intermediate transferring belt 7 is wound around a following roller 35, the facing roller 18 as a driving roller and a tension roller 36. Because the tension roller 36 biases the intermediate transferring belt 7 from the inside to the outside, given tensile strength is added to the intermediate transferring belt 7.

At the opposite sides of the photosensitive drums 2*a*, 2*b*, 2*c* and 2*d* across the intermediate transferring belt 7, the first transfer rollers 37*a*, 37*b*, 37*c* and 37*d* are respectively located facing to the photosensitive drums 2*a*, 2*b*, 2*c* and 2*d*.

Given parts of the intermediate transferring belt 7 are held between the first transfer rollers 37*a*, 37*b*, 37*c* and 37*d* and photosensitive drums 2*a*, 2*b*, 2*c* and 2*d*. The held parts are respectively pressed to the surfaces of the photosensitive drums 2*a*, 2*b*, 2*c* and 2*d*. Between the photosensitive drums 2*a*, 2*b*, 2*c* and 2*d* and first transfer rollers 37*a*, 37*b*, 37*c* and 37*d*, first transfer nips N1*a*, N1*b*, N1*c* and N1*d* are respectively formed. In the first transfer nips N1*a*, N1*b*, N1*c* and N1*d*, the respective color toner images developed to the photosensitive drums 2*a*, 2*b*, 2*c* and 2*d* are first-transferred to the intermediate transferring belt 7 in sequence. Thereby, a full color toner image is formed to the intermediate transferring belt 7.

To the respective first transfer rollers 37*a*, 37*b*, 37*c* and 37*d*, a first transfer bias applying part (not shown) applies respective first transfer biases which are used for transferring the respective color toner images formed on the photosensitive drums 2*a*, 2*b*, 2*c* and 2*d* to the intermediate transferring belt 7.

The static eliminators 12*a*, 12*b*, 12*c* and 12*d* are respectively located facing to the surfaces of the photosensitive drums 2*a*, 2*b*, 2*c* and 2*d*. The static eliminators 12*a*, 12*b*, 12*c* and 12*d* irradiate the respective surfaces of the photosensitive drums 2*a*, 2*b*, 2*c* and 2*d* with lights to eliminate the first-transferred surfaces of the photosensitive drums 2*a*, 2*b*, 2*c* and 2*d* (to remove the electrical charges).

The drum cleaning parts 11*a*, 11*b*, 11*c* and 11*d* are respectively located facing to the surfaces of the photosensitive drums 2*a*, 2*b*, 2*c* and 2*d*. The drum cleaning parts 11*a*, 11*b*,

11*c* and 11*d* respectively remove toners and deposits remained on the surfaces of the photosensitive drums 2*a*, 2*b*, 2*c* and 2*d* and convey the removed toners and the like to a predetermined collecting mechanism to collect those.

The second transfer roller 8 second-transfers the full color toner image first-transferred on the intermediate transferring belt 7 to the sheet T. To the second transfer roller 8, a second transfer bias applying part (not shown) applies a second transfer bias which is used for transferring the full color toner image formed on the intermediate transferring belt 7 to the sheet T.

The second transfer roller 8 comes into contact with and separates from the intermediate transferring belt 7. Concretely, the second transfer roller 8 is configured to move between a contact position coming into contact with the intermediate transferring belt 7 and a separate position separating from the intermediate transferring belt 7. In detail, the second transfer roller 8 is located at the contact position when the full color toner image first-transferred on the intermediate transferring belt 7 is second-transferred to the sheet T, but located at the separate position otherwise.

At the opposite sides of the second transfer roller 8 across the intermediate transferring belt 7, the facing roller is located. Another given part of the intermediate transferring belt 7 is held between the second transfer roller 8 and facing roller 18. The sheet T is pressed to an outer face (a face on which the toner image is first-transferred) of the intermediate transferring belt 7. Between the intermediate transferring belt 7 and second transfer roller 8, a second transfer nip N2 is formed. In the second transfer nip N2, the full color toner image first-transferred to the intermediate transferring belt 7 is second-transferred to the sheet T.

The fixing part 9 melts and pressurizes the color toners forming the toner image second-transferred on the sheet T to fix color toners to the sheet T. The fixing part 9 includes a heating rotation member 9*a* heated by a heater and a pressurizing rotation member 9*b* pressurized to the heating rotation member 9*a*. The heating rotation member 9*a* and pressurizing rotation member 9*b* hold, pressurize and convey the sheet T on which the toner image is second-transferred. By conveying the sheet T in a state held between the heating rotation member 9*a* and pressurizing rotation member 9*b*, the toner transferred on the sheet T is melted and pressurized, and thereby, fixed on the sheet T.

Next, the sheet feeding/ejecting part KH will be described. As shown in FIG. 1, in a lower part of the apparatus main body M, two sheet feeding cartridges 52 storing the sheet Tare located so as to be vertically arranged. Each sheet feeding cartridges 52 is configured so as to be horizontally pulled out from the housing of the apparatus main body M. In the sheet feeding cartridge 52, a placement board 60 on which the sheet T is placed is located. In the sheet feeding cartridge 52, the sheet T is stored in a state piled on the placement board 60. The sheet T placed on the placement board 60 is fed to the conveying path L by a cartridge sheet feeding part 51 located to an end part (an end part at the left side in FIG. 1) at a sheet feeding side of the sheet feeding cartridge 52. The cartridge sheet feeding part 51 includes a double-feeding preventive mechanism composed of a forward feeding roller 61 picking up the sheet T on the placement board 60 and a pair of sheet feeding rollers 63 feeding the sheet T to the conveying path L one by one.

In a right side face (the right side in FIG. 1) of the apparatus main body M, the manual bypass sheet feeding part 64 is located. The manual bypass sheet feeding part 64 is provided as a main purpose of feeding the apparatus main body M with a sheet T with different size or type from the sheet T set to the sheet feeding cartridge 52. The manual bypass sheet feeding part 64 includes a manual bypass tray 65 forming a part of the right side face of the apparatus main body M in a closing state and a sheet feeding roller 66. The manual bypass tray 65 has a lower end turnably (openably/closably) attached to the apparatus main body M near the sheet feeding roller 66. On the manual bypass tray 65 in an opening state, the sheet T is placed. The sheet feeding roller 66 feeds the sheet T placed on the manual bypass tray 65 in the opening state to the manual bypass conveying path La.

In an upper side of the apparatus main body M, the first sheet ejecting part 50*a* and second sheet ejecting part 50*b* are located. The first sheet ejecting part 50*a* and second sheet ejecting part 50*b* eject the sheet T outside the apparatus main body M. The first sheet ejecting part 50*a* and second sheet ejecting part 50*b* will be described in detail as follows.

The conveying path L conveying the sheet T includes the first conveying path L1, second conveying path L2, third conveying path L3, manual bypass conveying path La, return conveying path Lb and post-process conveying path Lc. The first conveying path L1 conveys the sheet T from the cartridge sheet feeding part 51 to the second transfer nip N2. The second conveying path L2 conveys the sheet T from the second transfer nip N2 to the fixing part 9. The third conveying path L3 conveys the sheet T from the fixing part 9 to the first sheet ejecting part 50*a*. The manual bypass conveying path La is joined to the first conveying path L1 to convey the sheet fed from the manual bypass sheet feeding part 64 to the first conveying path L1. The return conveying path Lb inverts the sheet conveyed from an upper stream side to a lower stream side in the third conveying path L3 and returns the sheet to the first conveying path L1. The post-process conveying path Lc conveys the sheet conveyed from the upper stream side to the lower stream side in the third conveying path L3 to a post-process device (not shown) connected to the second sheet ejecting part 50*b*.

In the middle of the first conveying path L1, a first junction part P1 and a second junction part P2 are located. In the middle of the third conveying path L3, a first branch part Q1 is located. The first junction part P1 is a junction part of joining the manual bypass conveying path La to the first conveying path L1. The second junction part P2 is another junction part of joining the return conveying path Lb to the first conveying path L1. The first branch part Q1 is a branch part of having the post-process conveying path Lc branched from the third conveying path L3. The first branch part Q1 includes a rectification member 58. The rectification member 58 rectifies (switches) a conveyance direction of the sheet T conveyed from the fixing part 9 to the third conveying path L3 toward the first sheet ejecting part 50*a* or the post-process conveying path Lc toward the second sheet ejecting part 50*b*.

In the middle (in detail, between the second junction part P2 and second transfer roller 8) of the first conveying path L1, a sensor detecting the sheet T and the pair of registration rollers 80 are located. The pair of registration rollers 80 carries out skew (oblique sheet feeding) correction of the sheet T or adapts a timing of conveying the sheet T to an operation of forming the toner image by the image forming part GK. The sensor is located immediately before the pair of registration rollers 80 in the conveyance direction of the sheet T (at an upper stream side of the conveyance direction). The pair of registration rollers 80 are a pair of rollers carrying out the above-mentioned correction and timing adaption and conveying the sheet T on the basis of detection signal information from the sensor.

The return conveying path Lb is a conveying path provided for facing a reverse face (a non-print face) of an already printed face to the intermediate transferring belt 7 when a duplex printing is performed to the sheet T. The return conveying path Lb can invert the sheet T conveyed from the first branch part Q1 to a side of a sheet ejecting part 50 (the first sheet ejecting part 50*a* and second sheet ejecting part 50*b*) and return the sheet T to the first conveying path L1, and then, convey the sheet T to an upper stream side of the pair of registration rollers 80 located at the upper stream side of the second transfer roller 8. The sheet T inverted by the return conveying path Lb is treated by the second transfer nip N2 so that the given toner image is transferred to the non-print face.

At an end part of the third conveying path L3, the first sheet ejecting part 50*a* is provided. The first sheet ejecting part 50*a* is located at the upper side of the apparatus main body M. The first sheet ejecting part 50*a* is opened to a right face side (the right side, e.g. a side of the manual bypass sheet feeding part 64, in FIG. 1) of the apparatus main body M. The first sheet ejecting part 50*a* ejects the sheet T conveyed in the third conveying path L3 outside the apparatus main body M.

At an opened side of the first sheet ejecting part 50*a*, an ejected sheet accumulation part M1 is arranged. The ejected sheet accumulation part M1 is provided in an upper face (an outer face) of the apparatus main body M. The ejected sheet accumulation part M1 is formed by downwardly hollowing a part of the upper face of the apparatus main body M. A bottom face of the ejected sheet accumulation part M1 forms a part of the upper face of the apparatus main body M. In the ejected sheet accumulation part M1, the sheet T with the given toner image ejected from the first sheet ejecting part 50*a* is piled and accumulated.

At an end part of the post-process conveying path Lc, the second sheet ejecting part 50*b* is provided. The second sheet ejecting part 50*b* is located at the upper side of the apparatus main body M. The second sheet ejecting part 50*b* is opened to a left face side (the left side, e.g. a side to which the post-process device is connected, in FIG. 1) of the apparatus main body M. The second sheet ejecting part 50*b* ejects the sheet T conveyed in the post-process conveying path Lc outside the apparatus main body M. To an opened side of the second sheet ejecting part 50*b*, the post-process device (not shown) is connected. The post-process device carries out post-processes (stapling, punching and the others) of the sheet ejected from the image forming apparatus (the copying machine 1). Ina predetermined position of each conveying path, a sensor detecting the sheet may be located.

Next, a structure solving a paper jam (JAM) in the main conveying paths L1-L3 (hereinafter, the first conveying path L1, second conveying path L2 and third conveying path L3 are often called as a "main conveying path" in a lump) and return conveying path Lb will be simply described. As shown in FIG. 1, at the left face side (the left side in FIG. 1) of the apparatus main body M, the main conveying paths L1-L3 and return conveying path Lb are arranged so as to extend mainly in the upward and downward directions. At the left face side (the left side in FIG. 1) of the apparatus main body M, a cover body 40 is provided so as to form a part of a side face of the apparatus main body M. The cover body 40 has a lower end part connected to the apparatus main body M via a supporting axis 43. The supporting axis 43 is provided so that the axis direction runs along a direction traversing the main conveying paths L1-L3 and return conveying path Lb. The cover body 40 is configured to turn between a closing position (a position shown in FIG. 1) and an opening position (not shown) around the supporting axis 43.

The cover body 40 includes a first cover part 41 turnably connected to the apparatus main body M by the supporting axis 43 and a second cover part 42 turnably connected to the apparatus main body M by the same supporting axis 43. The first cover part 41 is located at the outer side of the second cover part 42 (a side near the side face) in the apparatus main body M. In FIG. 1, a hatching part indicated by a broken line lowering to the left is the first cover part 41 and another hatching part indicated by another broken line lowering to the right is the second cover part 42.

In a state of the cover body 40 positioning at the closing position, an outer face side of the first cover part 41 forms a part of the outer face (the side face) of the apparatus main body M. In addition, in the state of the cover body 40 positioning at the closing position, an internal face side (an inward side of the apparatus main body M) of the second cover part 42 forms apart of the main conveying paths L1-L3. Moreover, in the state of the cover body 40 positioning at the closing position, an internal face side of the first cover part 41 and an outer face side of the second cover part 42 form at least a part of the return conveying path Lb. That is, the return conveying path Lb is formed between the first cover part 41 and second cover part 42.

Because the copying machine 1 of the embodiment includes the above configured cover body 40, when the paper jam (JAM) is occurred in the main conveying paths L1-L3, by turning the cover body 40 from the closing position shown in FIG. 1 to the opening position (not shown) to open the main conveying paths L1-L3, it is possible to deal with the sheet jammed in the main conveying paths L1-L3. On the other hand, when the paper jam is occurred in the return conveying path Lb, by turning the cover body 40 to the opening position and turning the second cover part 42 to the inward side of the apparatus main body M (the right side in FIG. 1) around the supporting axis 43 to open the return conveying path Lb, it is possible to deal with the sheet jammed in the return conveying path Lb.

Next, the development device will be described. The copying machine 1 suits four colors to include four sets of the photosensitive drum, laser scanning unit, toner cartridge, toner supply part, charger, drum cleaning part, static eliminator, development device and first transfer roller. Because these sets have similar configurations regardless of each color, hereinafter, the development device 16*a* will be representatively described.

Figure 2:
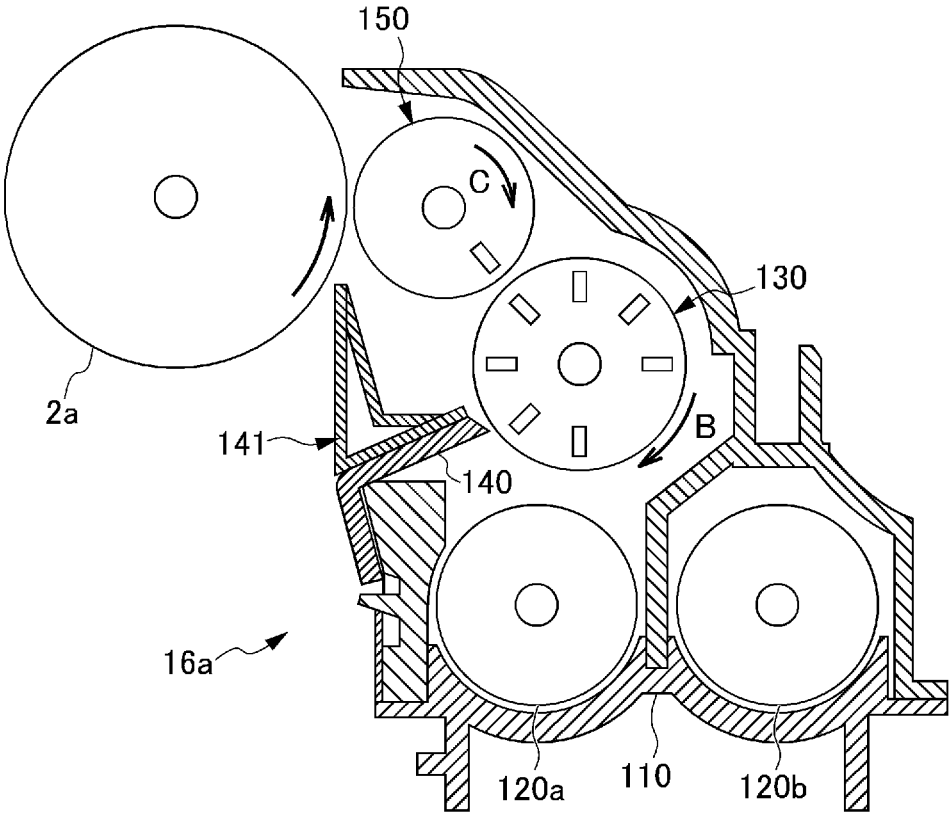
FIG. 2 is a sectional view schematically showing a development device and a photosensitive drum.

FIG. 2 is a figure used for explaining the development device 16*a* and photosensitive drum 2*a*. As shown in FIG. 2, the development device 16*a* includes a development case 110 containing the toner, stirring rollers 120*a* and 120*b*, a magnetic roller 130, a layer thickness adjusting blade 140, a scattered toner capturing cover 141 and a developing roller 150. The stirring rollers 120*a* and 120*b* are located inside the development case 110. The magnetic roller 130 is located above one stirring roller 120*a* in a vertical direction. The layer thickness adjusting blade 140 is located near the magnetic roller 130. The scattered toner capturing cover 141 is located above the layer thickness adjusting blade 140 in a vertical direction. The developing roller 150 is located facing to the magnetic roller 130.

To the development case 110, the toner is supplied from the toner cartridge 5*a* (refer to FIG. 1) via the toner supply part 6*a* (refer to FIG. 1). The stirring rollers 120*a* and 120*b* stir the toner contained in the development case 110. The magnetic roller 130 supplies the stirred toner to the developing roller 150.

The layer thickness adjusting blade 140 has a top end part facing to and coming into contact with a surface of the magnetic roller 130 to adjust layer thickness (height) of the toner held on the surface of the magnetic roller 130 and to keep the layer thickness constant. The scattered toner capturing cover 141 is a member forming apart of the case body of the development device 16*a*. The scattered toner capturing cover 141 is located above the layer thickness adjusting blade 140 to restrain the toner from scattering outside the development device 16*a*.

On a surface of the developing roller 150, the toner supplied from the magnetic roller 130 is carried and a toner layer is formed. To the developing roller 150, bias voltage superimposed direct current or alternating current is applied by a voltage applying part (not shown). In the developing roller 150, by applying the bias voltage, the toner carried on the surface is moved to the photosensitive drum 2*a* to develop the electrostatic latent image formed on the photosensitive drum 2*a*.

Figure 3:
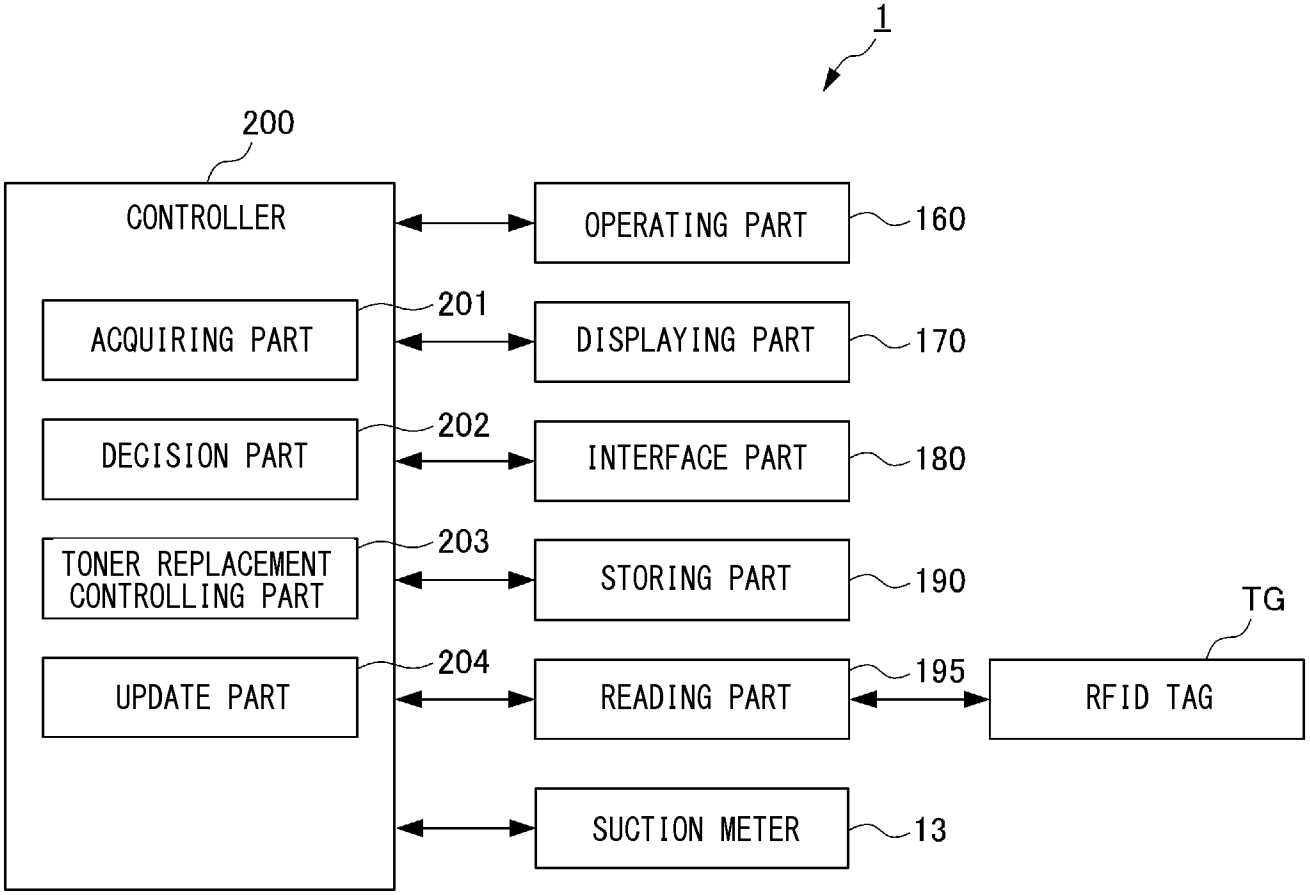
FIG. 3 is a block diagram schematically showing a functional configuration of the copying machine.

Next, a functional configuration of the copying machine 1 will be described. FIG. 3 is a block diagram schematically showing the functional configuration of the copying machine 1. The copying machine 1 includes, in addition to the above-mentioned configuration, a suction meter 13 as an electric charge amount measuring part, an operating part 160, a displaying part 170, an interface part 180, a storing part 190 as a second storage, a reading part 195 and a controller 200.

The suction meter 13 includes an inhalation nozzle (not shown) to individually inhale the toners contained in the development devices 16*a*, 16*b*, 16*c* and 16*d* via the inhalation nozzle. The suction meter 13 measures an electric charge amount of the sucked toner and outputs the measured result to the controller 200 mentioned below. The suction meter 13 individually measures the electric charge amount of the toner in the development devices 16*a*, 16*b*, 16*c* and 16*d* by inhaling the toner each of the development devices 16*a*, 16*b*, 16*c* and 16*d*.

Concretely, the suction meter 13 comes into contact with a toner intake port provided in each development device to inhale the toner via the toner intake port. The toner intake port is covered by a metal mesh. A bore diameter of the mesh is larger than the toner composing the developer and sufficiently smaller than a carrier composing the developer. The toner intake port comes into contact with the inhalation nozzle of the suction meter 13. Thereby, the toner contained in each development device is inhaled in the suction meter 13 via the toner intake port by driving the suction meter 13.

The operating part 160 includes a plurality of keys (not shown). As an example, the operating part 160 is operated in case of changing settings or resetting jobs of the copying machine 1. When any key of the operating part 160 is operated, the operating part 160 transmits a signal indicating such a key operation to the controller 200.

The displaying part 170 displays various information that a remaining quantity of the toner contained in the toner cartridge 5*a*, 5*b*, 5*c* or 5*d* is little and that the sheet T is not stored in the sheet feeding cartridge 52. The interface part 180 is connected to an external device (for example, a personal computer or the like) installed at the exterior of the copying machine 1.

The storing part 190 is configured by a hard disk, a semiconductor memory or the like. The storing part 190 stores image data transmitted from the above-mentioned external device. The storing part 190 also stores control programs used in the copying machine 1 and data used in the control programs. In addition, the storing part 190 stores developer information acquired by an acquiring part 201 mentioned below. In the storing part 190, for example, toner information is stored in advance when the product is shipped.

The reading part 195 reads the developer information stored in the RFID tags TG of the toner cartridges 5*a*, 5*b*, 5*c* and 5*d* installed in the housing. The reading part 195 transmits the read developer information to the controller 200.

The controller 200 carries out promotional control of discharge and replenishment of the toner contained in the development devices 16*a*, 16*b*, 16*c* and 16*d*.

The copying machine 1 suits four colors to include four sets of the photosensitive drum, laser scanning unit, toner cartridge, toner supply part, charger, drum cleaning part, static eliminator, development device and first transfer roller. These sets have similar configurations regardless of each color as mentioned above. Hereinafter, the promotional control of discharge and replenishment of the toner contained in the development device 16*a* when the toner cartridge 5*a* is replaced will be representatively described.

The controller 200 decides whether or not composition of the toner contained in the replaced toner cartridge 5*a* is different from composition of the toner contained in the development device 16*a*, when toner cartridge 5*a* is replaced. As a result of the decision, when both the compositions are different from each other, the controller 200 carries out the promotional control of the discharge of the toner contained in the development device 16*a* and the replenishment of the toner contained in the toner cartridge 5*a* installed in the housing to the development device 16*a*.

Figure 4:
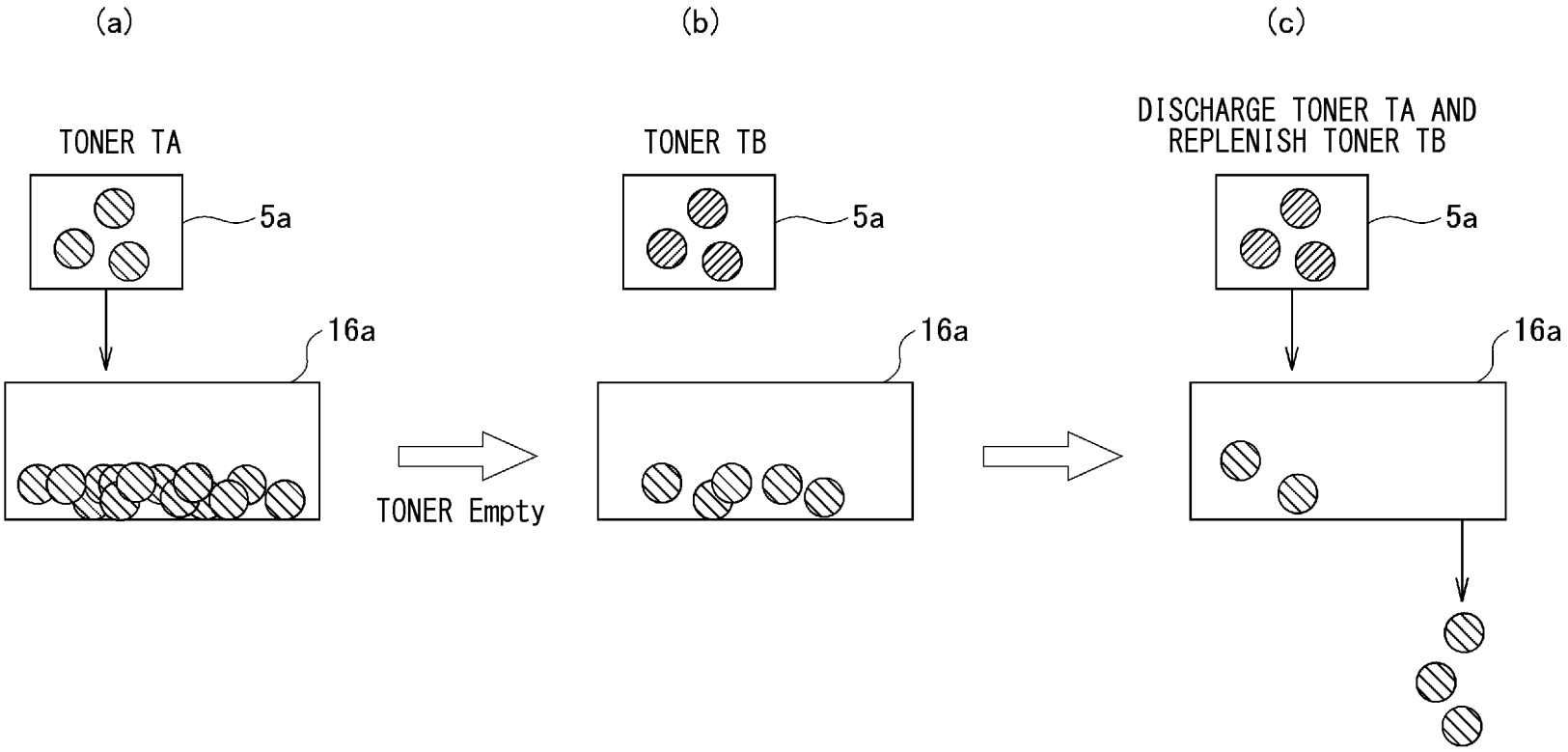
FIG. 4 is a schematic diagram schematically showing promotional control of toner replacement.

FIG. 4 is a figure used for explaining the promotional control of toner replacement according to the embodiment. In FIG. 4, for example, a state (a) that the toner cartridge 5*a* containing a toner TA having a first composition is installed to the development device 16*a* is illustrated. If the toner TA contained in the toner cartridge 5*a* in this state (a) is exhausted, the development device 16*a* becomes another state (b) that the toner TA is remained. In this state (b), if the toner in the toner cartridge 5*a* is changed to another toner TB with a second composition due to running change, compatibility or the like, it is possible to mix the toner TA and toner TB in the development device 16*a* and to degrade an image quality. However, in the copying machine 1, as a further state (c) illustrated in FIG. 4, the toner TA contained in the development device 16*a* is forcibly discharged, and then, the toner TB contained in the new installed toner cartridge 5*a* is replenished to the development device 16*a*.

To carry out the above-mentioned promotional control of the toner replacement, the controller 200 includes, as shown in FIG. 3, the acquiring part 201, a decision part 202, a toner replacement controlling part (a developer replacement controlling part) 203 and an update part 204.

The acquiring part 201 acquires the developer information stored in the RFID tags TG of the toner cartridge 5*a*, when the toner cartridge 5*a* is installed to the housing. Concretely, the acquiring part 201 detects the installation of the toner cartridge 5*a* to the housing, and then, controls the reading part 195 so as to acquire the developer information stored in the RFID tags TG of the toner cartridge 5*a*. Subsequently, the acquiring part 201 acquires the developer information outputted from the reading part 195.

The decision part 202 decides whether or not a composition of the toner indicated by the existing developer information is different from another composition of the toner indicated by the new developer information newly acquired by the acquiring part 201, when the existing developer information is stored in the storing part 190.

The toner replacement controlling part 203 controls discharge of the toner contained in the development device 16*a* and replenishment of the toner contained in the toner cartridge 5*a* installed in the housing to the development device 16*a* on the basis of the electric charge amount measured by the suction meter 13, when the decision part 202 decides that both the toner compositions are different from each other. The toner replacement controlling part 203 controls the discharge and replenishment of the toner contained in the development device 16*a* mentioned below.

That is, the toner replacement controlling part 203 controls the charger 10*a* so as to charge the surface of the photosensitive drum 2*a*, when the decision part 202 decides that both the toner compositions are different from each other. Next, the toner replacement controlling part 203 controls the laser scanning unit 4*a* so as to scan and expose the surface of the photosensitive drum 2*a* and to form the electrostatic latent image. Subsequently, the toner replacement controlling part 203 controls so that the toner is discharged from the development device 16*a* and is applied to the electrostatic latent image formed on the surface of the photosensitive drum 2*a*. After that, the toner replacement controlling part 203 controls the drum cleaning part 11*a* so as to remove the toner or the like adhered on the surface of the photosensitive drum 2*a*. The toner replacement controlling part 203 controls so that a series of these processes is repeated multiple times, thereby forcing to discharge the toner contained in the development device 16*a*. In such a case, the toner replacement controlling part 203 does not control drive of the forward feeding roller 61 and sheet feeding roller 66 picking up the sheet T on the placement board 60. Therefore, the sheet T is not fed to the photosensitive drum 2*a*.

Subsequently, the toner replacement controlling part 203 controls an electric motor of the development device 16*a* to replenish the toner contained in the toner cartridge 5*a* to the development device 16*a*. In this time, the toner replacement controlling part 203 may control so as to measure the discharge quantity and to replenish the same quantity of the toner as the measured discharge quantity from the toner cartridge 5*a*.

Figure 5:
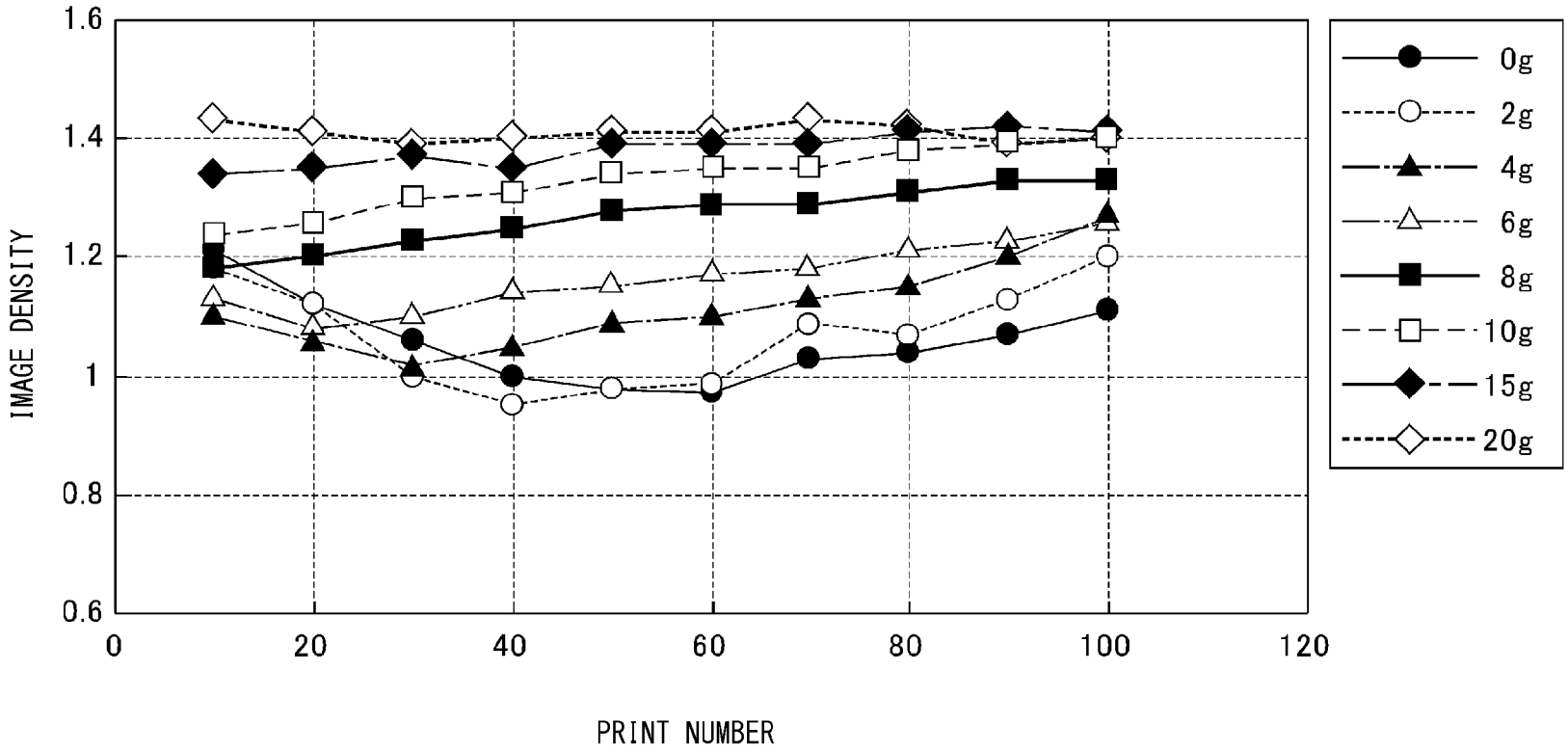
FIG. 5 is a graph plotting relationships of the print number and image density in accordance with various toner discharge quantities.

FIG. 5 is a graph plotting relationships of the print number and image density in accordance with various toner discharge quantities. The relationships may be defined that an image quality in a case of high image density is higher than another image quality in another case of low image density. In FIG. 5, it is possible to confirm that the image density is heightened as the toner discharge quantity increases even if the print number is small. Therefore, the toner replacement controlling part 203 may accept selection of the toner discharge quantity to control the toner discharge according to the selected discharge quantity. Thereby, it is possible to make a user select whether or not the image quality is early improved.

As the embodiment, in a case where the carrier and toner are contained in the development device 16*a*, if toner density in the development device 16*a* becomes too low, the electric charge amount of the toner increases more than necessary. In such a state that the electric charge amount of the toner increases, when the toner is supplied, it is possible to transfer the toner more than the usual to the photosensitive drum 2*a* and to cause image fog.

Figure 6:
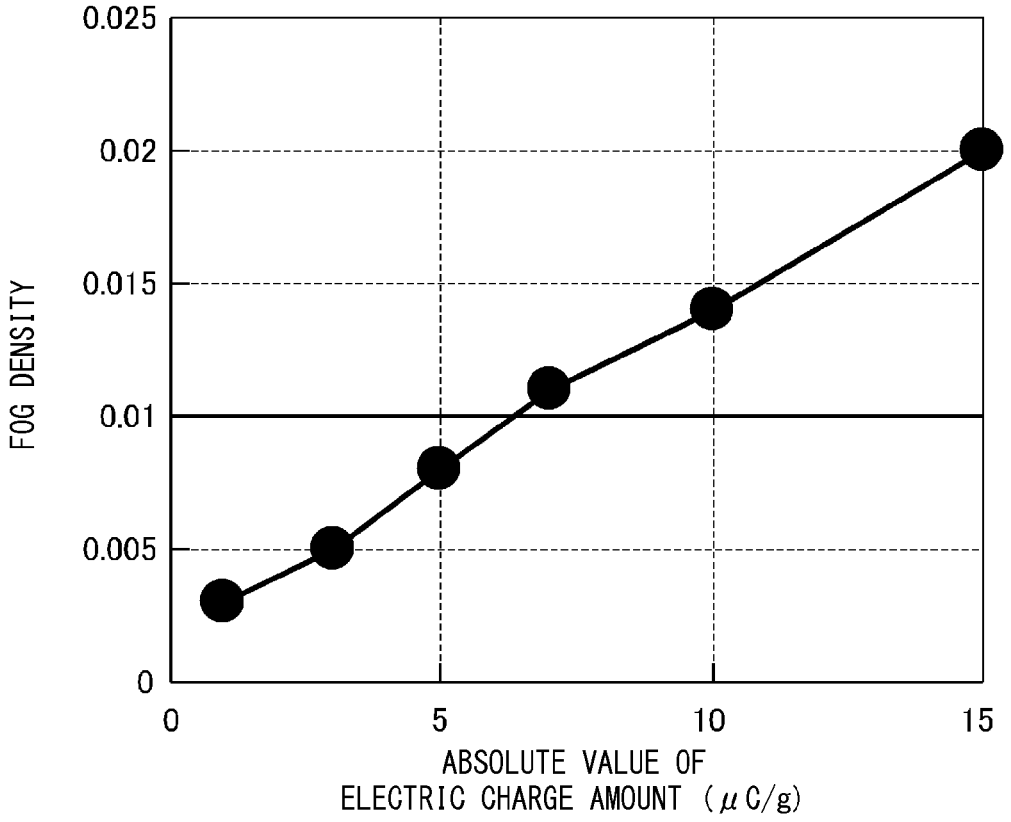
FIG. 6 is a graph plotting a relationship of the absolute value of an electric charge amount of the toner and a fog density.

FIG. 6 is a graph plotting a relationship of the absolute value of the electric charge amount of the toner and a fog density according to the embodiment. The relationship may be defined that the image quality is heightened when the fog density is 0.01 or less. In FIG. 6, it is possible to confirm that when the absolute value of the electric charge amount of the toner is within |5| μC/g, the fog density becomes 0.01 or less and the image quality is heightened. The value of |5| μC/g is −5 μC/g or more and 5 μC/g or less.

Accordingly, the toner replacement controlling part 203 controls so as to discharge the toner contained in the development device 16*a*, when the electric charge amount measured by the suction meter 13 is outside |5| μC/g, until the electric charge amount becomes within the range of −5 to 5 μC/g. More concretely, the toner replacement controlling part 203 controls the suction meter 13 so as to measure the electric charge amount of the toner contained in the development device 16*a*, when the decision part 202 decides that both the toner compositions are different from each other. Next, the toner replacement controlling part 203 controls the photosensitive drum 2*a*, laser scanning unit 4*a*, charger 10*a*, drum cleaning part 11*a* and development device 16*a* so as to forcibly discharge the toner contained in the development device 16*a*, when the electric charge amount measured by the suction meter 13 is outside |5| μC/g. Subsequently, the toner replacement controlling part 203 controls so that, until the electric charge amount becomes within |5| μC/g, the measurement of the electric charge amount of the toner contained in the development device 16*a* and the forced discharge of the toner contained in the development device 16*a* are repeated.

The update part 204 updates the existing developer information stored in the storing part 190 to the new developer information newly acquired by the acquiring part 201, when the decision part 202 decides that both the toner compositions are different from each other.

Figure 7:
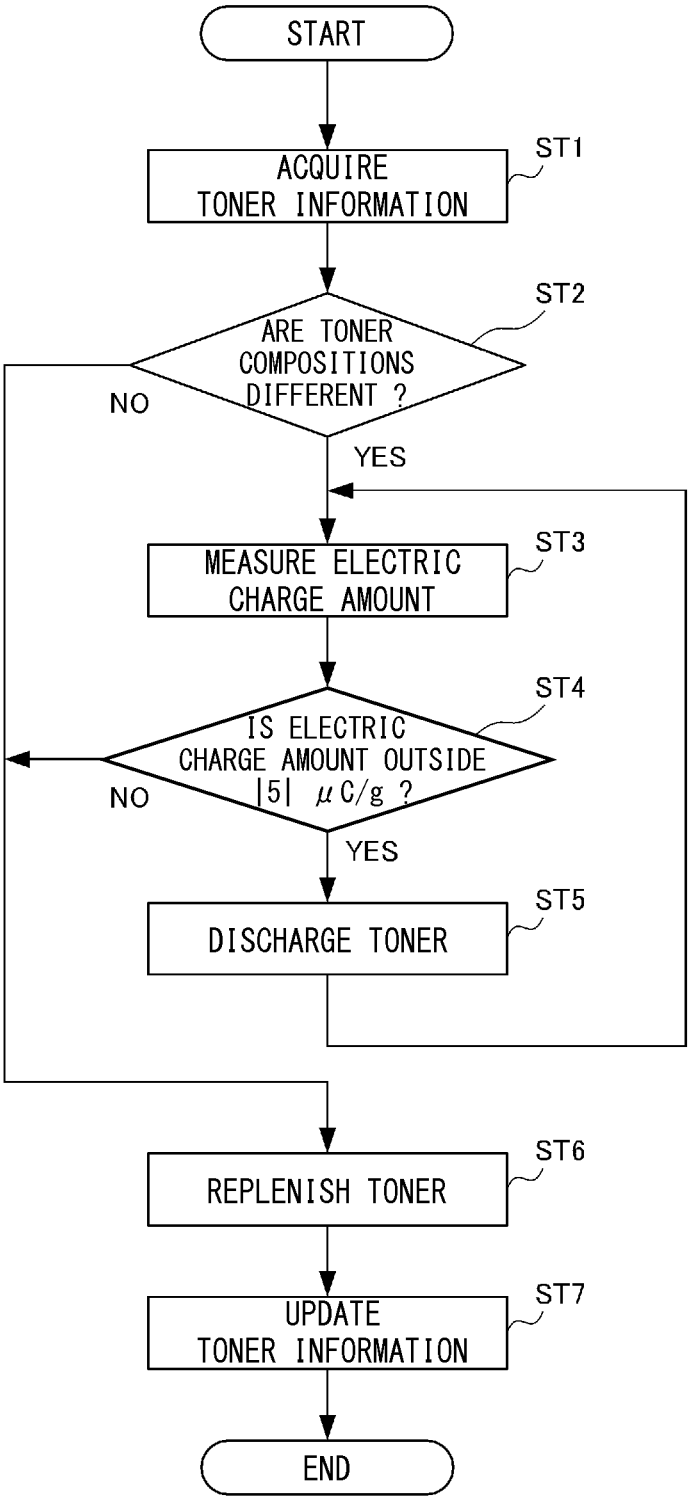
FIG. 7 is a flowchart explaining an operation of a printer.

Next, an operation of the copying machine 1 according to the embodiment will be described. FIG. 7 is a flowchart used for explaining an operation of a printer. The flowchart illustrates processes carried out when the toner cartridge 5*a* shifts from a non-installation state to an installed state.

In a step ST1, the acquiring part 201 acquires the new developer information stored in the RFID tags TG of the toner cartridge 5*a* installed to the housing. In a step ST2, the decision part 202 decides whether or not the composition of the toner indicated by the existing developer information stored in the storing part 190 is different from the other composition of the toner indicated by the new developer information newly acquired by the acquiring part 201. When the decision of the decision part 202 results in YES, the processing of the flowchart advances to a step ST3. On the other hand, when the decision results in NO, the processing advances to a step ST6.

In the step ST3, the toner replacement controlling part 203 controls the suction meter 13 so as to measure the electric charge amount of the toner contained in the development device 16*a*.

In a step ST4, the toner replacement controlling part 203 decides whether or not the electric charge amount of the toner measured in the step ST3 is outside |5| μC/g. When the decision of the toner replacement controlling part 203 results in YES, the processing advances to a step ST5. On the other hand, when the decision results in NO, the processing advances to the step ST6.

In the step ST5, the toner replacement controlling part 203 controls the photosensitive drum 2*a*, charger 10*a*, laser scanning unit 4*a*, development device 16*a* and drum cleaning part 11*a* so as to forcibly discharge the toner contained in the development device 16*a*. When this process of the toner replacement controlling part 203 is completed, the processing returns to the step ST3.

In the step ST6, the toner replacement controlling part 203 controls to drive the toner supply part 6*a*, thereby replenishing the toner in the toner cartridge 5*a* to the development device 16*a*.

In a step ST7, the update part 204 updates the existing developer information stored in the storing part 190 to the new developer information newly acquired in the step ST1.

As mentioned above, in accordance with the embodiment, in the copying machine 1, when the toner cartridge 5*a* is installed to the housing, the acquiring part 201 acquires the new developer information stored in the RFID tags TG of the toner cartridge 5*a*. Subsequently, when the existing developer information is stored in the storing part 190, the decision part 202 decides whether or not the composition of the toner indicated by the existing developer information is different from the other composition of the toner indicated by the new developer information newly acquired by the acquiring part 201. And then, in the copying machine, when the decision part 202 decides that both the toner compositions are different from each other, the toner replacement controlling part 203 controls the discharge of the toner contained in the development device 16*a* and the replenishment of the toner contained in the toner cartridge 5*a* installed in the housing to the development device 16*a* on the basis of the electric charge amount measured by the suction meter 13.

Therefore, the copying machine 1 can carry out the discharge of the toner contained in the development device 16*a* and the replenishment of the toner contained in the toner cartridge 5*a* installed in the housing to the development device 16*a* on the basis of the electric charge amount. Thereby, it is possible to early stabilize the image quality of the printed matter in comparison with a case where the toner contained in the development device 16*a* is not replaced.

Moreover, in the copying machine 1, the toner replacement controlling part 203 controls so as to discharge the toner contained in the development device 16*a* until the electric charge amount measured by the suction meter 13 becomes within |5| μC/g.

Therefore, the copying machine 1 can restrain the fog density of the printed matter to 0.01 or less and heighten the image quality of the printed matter.

The disclosure is not restricted to the above-mentioned embodiment, but can be actualized by other various embodiments.

For example, the copying machine 1 may calculate, after the discharge of the toner and the replenishment of the toner controlled by the toner replacement controlling part 203 are completed, a mixture rate of the new and existing toners on the basis of the discharge quantity and replenishment quantity of the toner and store the mixture rate in the storing part 190. Subsequently, in printing, the copying machine 1 may adjust supply quantity of the toner from the development device on the basis of the mixture rate stored in the storing part 190 to improve the image quality. In addition, the copying machine 1 may update the mixture rate of the new and existing toners stored in the storing part 190 on the basis of the discharge quantity and replenishment quantity of the toner according to completion of the printing.

Moreover, although the printer 1 as the embodiment is configured to discharge the toner, the printer 1 is not restricted to this configuration. For example, the printer 1 may be configured to use another developer adapted to trickle development and to discharge the toner and carrier. In such a configuration, the toner cartridge 5*a* may supply the toner and carrier to the development device 16*a*. In addition, the development device 16*a* may include a discharge port discharging the toner and carrier. The toner replacement controlling part 203 may control to discharge the toner and carrier contained in the development device 16*a* via the discharge port.

In such a case, the developer information may include composition information of the toner and carrier. Accordingly, when the existing developer information is stored in the storing part 190, the decision part 202 decides whether or not a composition of at least one of the toner and carrier is different between the existing developer information and the new developer information newly acquired by the acquiring part 201. And then, when the decision part 202 decides that a composition of at least one of the toner and carrier is different between both the developer information, the toner replacement controlling part 203 controls to discharge the toner and carrier.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. An image forming apparatus comprising:

an installed part to which a case is installed, wherein the case contains a developer and includes a first storage storing developer information indicating a composition of the contained developer;

a developing part receiving the developer supplied from the developer-containing case installed to the installed part and supplying the received developer to a surface of an image carrier;

an acquiring part acquiring the developer information stored in the first storage of the developer-containing case, when the developer-containing case is installed to the installed part;

a second storage storing the developer information acquired by the acquiring part;

a decision part deciding, when the developer-containing case is replaced, whether or not a composition of developer included in existing developer information is different from a composition of developer included in new developer information newly acquired by the acquiring part; wherein, when the compositions of the developers are different from each other, the new developer information is stored in the second storage to replace the existing developer information;

an electric charge amount measuring part being a suction meter to inhale the developer contained in the developing part and to measure an electric charge amount of the inhaled developer;

a developer replacement controlling part controlling discharge of the developer contained in the developing part and replenishment of developer to the developing part from the developer contained in the developer-containing case installed in the installed part on the basis of the electric charge amount measured by the electric charge amount measuring part, when the decision part decides that the compositions of the developer included in the existing developer information and the developer included in the new developer information are different from each other, so that the developer contained in the developing part is discharged until the electric charge amount measured by the electric charge amount measuring part becomes within the range of −5 to 5 μC/g of a target electric charge amount.

2. The image forming apparatus according to claim 1, wherein, after the discharge of the developer and the replenishment of the developer controlled by the developer replacement controlling part are completed, a mixture rate of the new and existing developers is calculated on the basis of a discharge quantity and a replenishment quantity of the developer, and in printing, a supply quantity of the developer from the developing part is adjusted on the basis of the mixture rate to improve image quality.

3. The image forming apparatus according to claim 1, wherein the developer information indicates composition information of a toner and a carrier, the decision part decides, when the developer-containing case is replaced, whether or not a composition of at least one of the toner and the carrier is different between the existing developer information and the new developer information newly acquired by the acquiring part; wherein, when a composition of at least one of the toner and the carrier is different between the existing developer information and the new developer information, the new developer information is stored in the second storage to replace the existing developer information, and the developer replacement controlling part controls to discharge the toner and the carrier.

* * * * *